United States Patent [19]

DiFazio

[11] 4,058,332

[45] Nov. 15, 1977

[54] ASTRAGAL AND FLUSH BOLT ASSEMBLY

[75] Inventor: Joseph DiFazio, Troy, Mich.

[73] Assignee: Acorn Building Components, Inc., Detroit, Mich.

[21] Appl. No.: 654,444

[22] Filed: Feb. 2, 1976

[51] Int. Cl.[2] ..... E05C 1/04; E05C 7/04

[52] U.S. Cl. ..... 292/147; 49/368; 49/503; 292/340; 292/DIG. 21

[58] Field of Search ..... 292/145, 147, 340, DIG. 21, 292/152, 153, 32-43; 49/366-369, 394, 503, 504, DIG. 1; 52/207, 211

[56] References Cited

U.S. PATENT DOCUMENTS

| | | | |
|---|---|---|---|
| 3,281,177 | 10/1966 | Tenenbaum | 292/340 X |
| 3,487,581 | 1/1970 | Ellingson, Jr. | 49/366 X |
| 3,649,060 | 3/1972 | Ruff | 292/147 X |
| 3,660,940 | 5/1972 | Tavano | 49/366 |
| 3,680,901 | 8/1972 | Biebuyck | 292/36 |
| 3,806,175 | 4/1974 | Van Herpen | 292/147 |

FOREIGN PATENT DOCUMENTS

| | | | |
|---|---|---|---|
| 320,998 | 5/1957 | Switzerland | 49/DIG. 1 |
| 434,924 | 9/1935 | United Kingdom | 292/147 |
| 1,017,570 | 1/1966 | United Kingdom | 292/147 |

*Primary Examiner*—Roy D. Frazier
*Assistant Examiner*—William E. Lyddane
*Attorney, Agent, or Firm*—Cullen, Settle, Sloman & Cantor

[57] ABSTRACT

An improved astragal and flush bolt assembly to be secured to a relatively stationary member such as a door jamb or to the edge of an inactive door of a pair of double doors or the like. The astragal assembly includes a flat metal body mounted on the edge of the stationary member and a metal stop member secured to the body along one edge thereof. The flat body includes first and second spaced apart legs extending outwardly from the stationary member with the flat body and legs defining a channel to receive and retain a door latch bolt from the active door. The stop member prevents movement of the door in a first direction and when the latch bolt is engaged in the channel, the channel and latch bolt prevent the door from moving in the opposite direction. A pair of flush bolts are slidably mounted in the channel, one adjacent each end thereof, so that when the astragal assembly is utilized with double doors, the flush bolts are moved to engage the header and sill, respectively, to hold the inactive door stationary. The astragal body is secured to the stop member by a thermal barrier or thermal break structure to provide thermal insulation between the inside and the outside of the doors. The stop member also includes a weather strip to form a tight seal against the active door and when metal doors or metal covered doors are used, the weather strip may include a magnetic member to form a tight seal against the active door.

8 Claims, 5 Drawing Figures

ASTRAGAL AND FLUSH BOLT ASSEMBLY

BACKGROUND OF THE INVENTION

The present invention relates to an improved astragal assembly of the type commonly mounted on the edge of a stationary or inactive door of a pair of double doors.

Astragal assemblies of this general type are, of course, well known as exemplified by U.S. Pat. No. 3,649,060, to Robert O. Ruff, issued Mar. 14, 1972. The astragal is mounted on the edge of the inactive door and provides an edge or stop member for the active door in a pair of double doors. As set forth in the aforementioned patent, flush bolts may be slidably mounted in the astragal, at the top and bottom thereof, so that these bolts may be moved to engage the header and sill of the door frame, respectively, to maintain the inactive door stationary. When the flush bolts are withdrawn, the inactive door may be swung open.

Various problems have been encountered with the prior astragal assemblies. For example, with reference to the Ruff U.S. Pat. No. 3,649,060, suitable apertures must be milled in the astragal to permit access for the latch bolt of the active door to engage a suitable keeper in the inactive door. Furthermore, the usual carpentry is required to install a striker plate and keeper in the inactive door. Additionally, the sliding flush bolt is positioned between the astragal body and the edge of the inactive door and thus access holes must be milled in the astragal to permit access to the flush bolt so that the flush bolt may be slid to engage conventional keepers in the header and sill of the door frame. Finally, the type of flush bolt assembly previously used has integral resilient prongs or tines to frictionally engage the astragal channel to retain the flush bolt in an engaged or withdrawn position. Thus, when one of the tines or prongs breaks, it is necessary to replace the entire flush bolt.

Thus the present invention overcomes these problems with the provision of an improved astragal and flush bolt assembly.

SUMMARY OF THE INVENTION

The present invention provides an improved astragal assembly to be mounted on the edge of an inactive door of a pair of double doors. Additionally, the astragal of the present invention may be mounted on the door jamb when only a single door is being utilized and, of course, the flush bolts would not be necessary. The improved astragal of the present invention includes an elongated metal channel opening outwardly from the edge of the inactive door toward the active door to receive and retain the door latch bolt from the active door. Additionally, the present astragal assembly provides a striker plate for the door latch bolt of the active door.

The channel of the present astragal also serves as a guide for a slidable flush bolt with the flush bolt exposed for easy access. The flush bolt is mounted in the channel by resilient springs and should a spring break, a replacement spring may be easily installed without the need for a new flush bolt.

Additionally, while astragal assemblies commonly provide a stop member to limit the swinging movement of the active door, in a first direction, the present astragal assembly contemplates a fully insulated thermal barrier or break between the astragal channel and the stop member to prevent the astragal from conducting heat and cold between the interior and exterior of the house. Weather stripping is provided on the astragal assembly and, when metallic doors are utilized, the weather stripping may be fully magnetic to maintain a tight seal between the astragal and the active door.

BRIEF DESCRIPTION OF THE DRAWINGS

The foregoing objects and advantages of the present invention, together with other advantages which may be attained by its use, will become more apparent upon reading the following detailed description taken in conjunction with the drawings.

In the drawings, wherein like reference numerals identify corresponding parts of the astragal and flush bolt assembly.

DETAILED DESCRIPTION OF THE INVENTION

Figure 1:
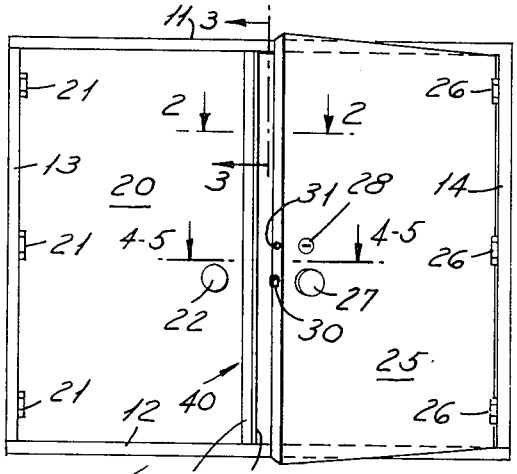
FIG. 1 is a front elevation view illustrating a pair of double doors mounted in a frame, with the active door partially open and with the astragal assembly of the present invention mounted on the inactive door.

In order to appreciate the advantages and benefits of the inventive concept, reference should first be had to FIG. 1 which illustrates a conventional double door assembly 10 mounted in a door frame including a header 11 a sill 12 and opposed vertical door jambs 13 and 14. A first door 20 is secured by hinges 21 to the jamb 13. This door is normally maintained in a closed position and is thus referred to as the inactive door of the double door assembly. However, this door includes a conventional handle 22 and may be swung about its hinges and used when desired.

Also mounted to the door frame is the active door 25 which is mounted by hinges 26 to the door jamb 14. This door is normally used for entrance and egress purposes and thus has a conventional handle 27 as well as an additional optional lock mechanism 28. A latch bolt 30 associated with the handle 27 is of the spring loaded type which moves inwardly of the door upon contact with a striker plate. The latch 31 of the lock 28 is illustrated as being of the dead bolt type which requires manual turning of the lock 28 to move the latch bolt.

The doors themselves may be manufactured of wood, metal, or may be of the type having a wood frame 32 surrounding an internal core 33 of an insulating material such as a urethane or the like. Metal sheets 34 are provided on each side of the door and the wooden frame members are slotted as at 35 to provide a receptacle into which the edges of the sheet metal may be turned. An insulating barb 36 may be utilized to hold the edges of the sheet metal flush against the wooden frame. All of this door structure is now conventional as described in my U.S. Pat. No. 3,837,134 of Sept. 24, 1974 entitled Sheet Metal Faced Slab Door and assigned to the assignee of the present invention.

Figure 2:
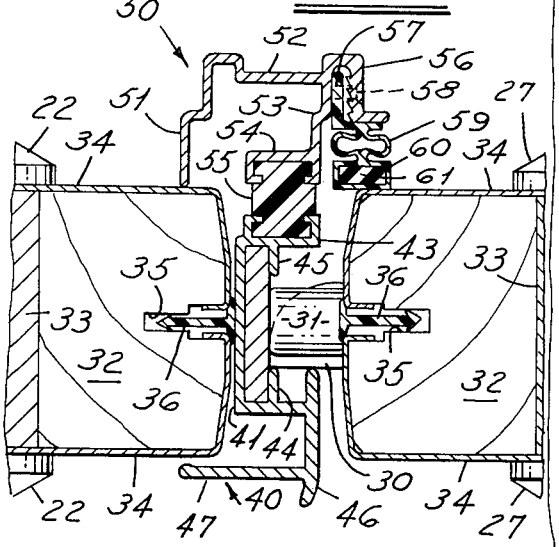
FIG. 2 is a cross sectional plan view as illustrated in the plane of arrows 2—2 of FIG. 1 with both the inactive door and the active door illustrated in a closed position.
Figure 3:
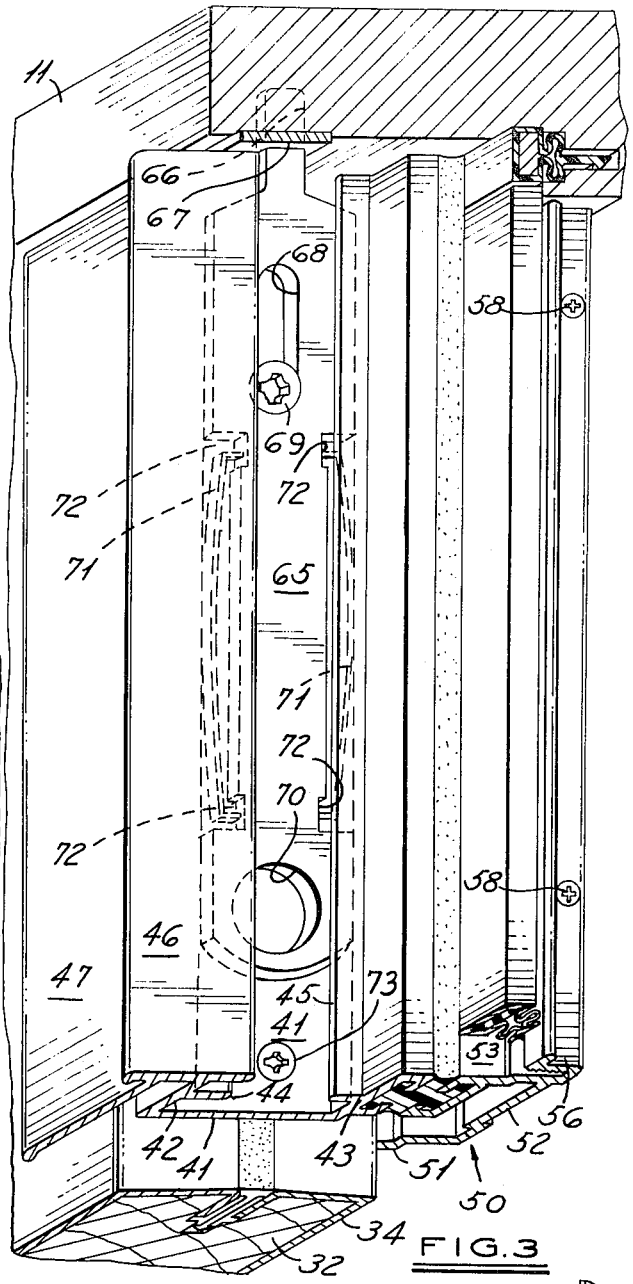
FIG. 3 is an enlarged partial perspective illustration of the upper end of the astragal assembly of the present invention mounted on the inactive door and illustrating the flush bolt assembly engaged with the door frame header, as seen in the plane of arrows 3—3 of FIG. 1.

With reference to FIGS. 2 and 3 the astragal 40 of the present invention will be explained in greater detail. The astragal includes a flat elongated metal body portion 41 which is mounted against the edge of the stationary door. The ends of the body terminate in opposed outwardly extending first and second legs 42,43 respectively so that the legs and body define a channel which opens toward the active door. On each of the legs 42 and 43 there is formed an inwardly projecting leg or flange 44,45 respectively, to define a guide and, in addition, leg 42 terminates at its distal end in a flange 46 which functions as a striker plate for the conventional spring loaded latch 30 of the door. For aesthetic purposes this striker plate flange 46 has a flange 47 extending rearwardly therefrom to conceal the details of the astragal assembly from view when the door is closed.

The astragal assembly also includes a generally C-shaped metal stop assembly 50 which functions as a stop to limit the travel of the active door. This C-shaped stop assembly includes a first leg or flange 51 which abuts the exterior of the stationary door 20, a base 52 and a second leg or flange 53 generally parallel to the first leg 51. The second leg 53 terminates in a generally C-shaped rail 54 which may be rigidly secured to the leg 43 of the astragal assembly by an insulating material 55 to thus define a thermal barrier or thermal break between the astragal body and the stop assembly.

In practice, the astragal and stop assembly are initially a single unitary aluminum extrusion with a cavity defined between the C-shaped rail 54 and the leg 43 of the astragal. The cavity is filled with a liquid urethane material which hardens and adheres to the rail 54 and the leg 43 and then the unitary extrusion is severed to provide a thermal barrier structure. This technique is conventional.

The thermal barrier structure provides thermal insulation between the body of the astragal extrusion, which is attached to the edge of the inactive door, and the stop member of the astragal assembly which is secured transversely to the body and limits the swinging of the active door in a first direction. Thus the astragal and stop member do not conduct heat or cold from one side of the door to the other. Furthermore, when metal covered slab doors are utilized and an insulating barb 36 is used to secure the sheet metal exterior of the doors to the wooden core, there is complete thermal insulation between the outside and the inside of the door assembly.

In order to provide a weather-tight seal between the stop assembly 50 and the active door 25, a weather strip arrangement is provided according to the principles of the present invention. Specifically, an L-shaped flange 56 is secured to the outside of leg 53 of the stop member to define a cavity between the long leg of the "L" and leg 53. Weather stripping including an elongated rigid plastic such as rigid vinyl 57 is secured by screws 58 into this cavity. Formed integrally with the rigid vinyl is a flexible vinyl material 59, folded in an accordion fashion to abut against the base of the "L" flange 56. The flexible vinyl is secured to a hollow metal tube 60 into which a magnet 61 is secured. By this configuration, the attraction between the magnet 61 and the metal sheet 34 on the exterior of the active door 25 maintains contact between the weather stripping and the door itself. The folded flexible vinyl 59 permits contacts to be maintained along the entire length of the door.

The foregoing assembly may be utilized on a door jamb when only a single door is utilized as well as being utilized on the edge of a relatively inactive door 20. When double doors are utilized as illustrated in FIG. 1, it is conventional to provide a flush bolt assembly at the top and bottom of the astragal to secure the inactive door in the frame. The flush bolt is a thin flat elongated plate of metal such as chrome-plated steel and in the present invention it is mounted in the guide defined between the body 41 of the astragal and the two flanges 44 and 45. The flush bolt 65 illustrated in FIG. 3 is located, of course, at the top of the astragal assembly and thus has an upwardly extending end 66 of reduced width to fit through a conventional keeper 67 into a suitable aperture in the header 11. Obviously a flush bolt of reverse orientation, that is with its narrow end extending downwardly, will be provided at the bottom of the astragal assembly to engage a suitable aperture in the sill 12.

Each flush bolt includes an elongated slot 68 therethrough and a screw 69 extends through the slot into the body 41 of the astragal and then into the edge of the door. This screw not only holds the astragal assembly in place but serves to limit the sliding of the flush bolt assembly within the guide.

At the lower end of the flush bolt a finger hole 70 is provided for manual movement of the flush bolt into and out of engagement with the header 11. A pair of thin metal leaf springs 71 are provided, one positioned on each side of the flush bolt between its longitudinal edge and the interior edge of the guide, to resiliently hold the flush bolt in place and to prevent vertical movement thereof. The edges of the flush bolt may be recessed as at 72 to contact the ends of the spring. A screw 73 is illustrated generally in FIG. 3 for maintaining the astragal in position rigidly on the jamb or edge of an inactive door.

Based upon the foregoing explanation, certain benefits and advantages of the present construction will now be pointed out. As may be appreciated from the explanation of the structure of the present invention, there is an outwardly extending channel formed between the base or body of the astragal 41 and the two outwardly projecting legs 42,43. This channel includes interior legs 44 and 45 to provide a slideway or guide for the flush bolt. However, the flush bolt is exposed for easy access to the finger hole 70 and no milling through the body of the astragal is necessary. Furthermore, the use of springs rather than biased prongs on the end of the flush bolt permits the flush bolt to be removed, should a spring break, and the flush bolt used with a new spring. Typically, according to prior technology, when a flush bolt having a tine or prong was utilized, when a tine broke, it was necessary to remove and discard the flush bolt and use an entirely new flush bolt. Here only an inexpensive spring is required as a replacement part.

The open channel which provides convenient access to the flush bolt and provides a guide or slideway for the flush bolt performs an additional function which greatly reduces if not eliminates the carpentry necessary when installing doors. Typically when installing doors a suitable striker and keeper assembly had to be provided for the door latch bolt. In order to provide such a keeper assembly it was necessary to first mark the position on the door jamb (or edge of the inactive door) where the latch assembly would be engaged and then, using a chisel, remove a portion of the jamb to allow the keeper to lie flat within the plane of the edge of the jamb. Similarly, when using double doors, the edge of one of the doors had to be chiseled away to provide for the flush mounting of the keeper for the door latch assembly.

Furthermore, it was necessary to chisel out a portion of the door frame to install a keeper for a dead bolt latch when a dead bolt was desired. The dead bolt latch is not spring loaded but must be turned by operation of the lock and hence no striker plate is needed.

The present invention overcomes these problems by the unique concept of permitting the astragal to serve as both the striker plate and keeper for the latch bolt as well as the keeper for a dead bolt latch.

By way of further explanation, in a conventional door latch there is a spring-loaded latch bolt 30 which is biased to extend outwardly beyond the edge of the door. The latch bolt moves interiorly of the door when the bolt contacts a striker plate to allow the door to swing past the striker plate into a closed position. The door handle must be turned manually to withdraw the latch bolt to enable the door to be opened. All this is conventional and the rods 75 which couple the door handle to the spring and unlocking mechanism 76 are not illustrated in detail.

Figure 4:
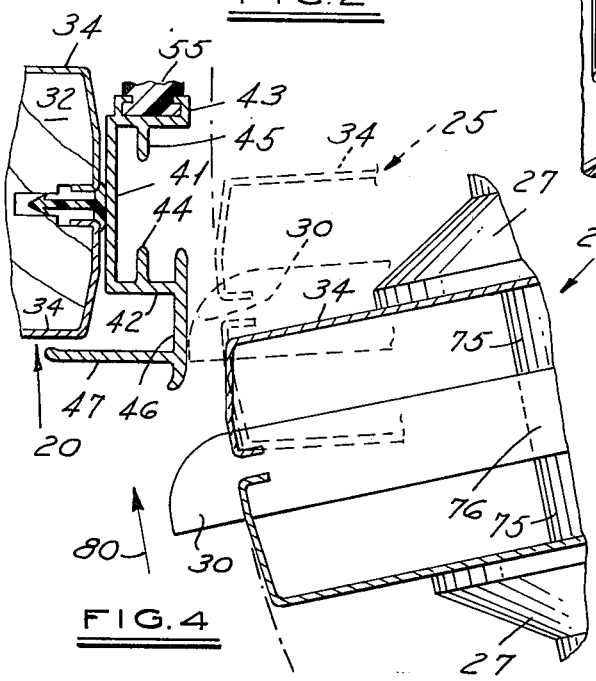
FIG. 4 is a partial cross sectional plan view of the astragal mounted on the inactive door as seen in the plane of arrows 4—4 of FIG. 1 and further illustrating the use of the astragal channel as a striker plate as the active door is being closed, the door being shown open in solid lines and shown partially closed in dotted lines.

With reference now to FIG. 4 there is illustrated in fragmentary view an inactive door 20 and the active door 25 shown in two positions, a first position in solid lines where the latch bolt is clear of the astragal and a second position in dotted lines where the latch bolt has contacted the astragal and is thus urged inwardly of the door against the bias of the lock assembly. By a consideration of FIG. 4 it may be appreciated that as the door is closed, such as by movement in the direction of arrow 80, the latch bolt 30 will contact the flange 46 of the astragal which functions as a striker plate. This contact causes the latch bolt to move inwardly of the door, against the bias, to allow the door to swing to a closed position.

Figure 5:
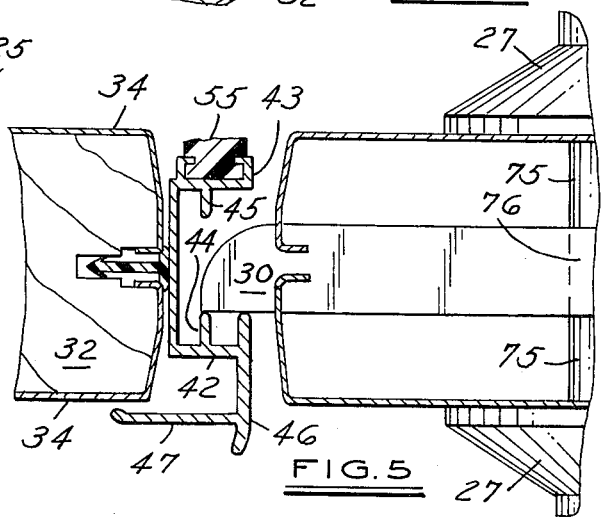
FIG. 5 is a partial cross sectional plan view similar to FIG. 4 but showing the two doors in a closed position with the latch bolt of the active door being engaged by the astragal assembly of the inactive door.

FIG. 5 illustrates the door in its closed position with the latch bolt 30 again biased outwardly. In this position the channel of the astragal functions as a keeper for the latch bolt assembly and, more specifically, the ends of flanges 44 and 46 provide a two-point contact with the side of the latch bolt to prevent opening of the door.

FIG. 2 illustrates the dead bolt 31 in an extended position with the astragal channel serving as a keeper for the dead bolt.

Thus it may be appreciated that the astragal of the present invention provides several new functions not found in the prior art. The astragal functions as a striker plate for the latch bolt and the astragal channel functions as a keeper for the latch bolt and for a dead bolt latch. The astragal channel alsoprovides a guide for a sliding flush bolt with the flush bolt totally accessible without the need for milling the astragal. Finally, since the astragal channel opens outwardly toward the edge of the active door, the screws 73 which fasten the astragal to the door jamb or inactive door do not have to be inserted through counter-sunk holes since there is clearance between the heads of the screws 73 and the latch bolts in their extended positions.

Thus, the astragal of the present invention provides the foregoing significant and unexpected advantages over the astragals of the prior art.

Having described an operative embodiment of the present invention, what is claimed is:

1. In an astragal assembly to be secured to a relatively stationary member such as a door jamb, or the edge of an inactive door or the like, said astragal including a generally flat elongated body to be mounted on said stationary member and a stop member secured to said body along one edge thereof to limit swinging movement of a relatively active door member, the improvement comprising:

first and second spaced apart elongated legs formed integrally with said flat body and extending outwardly therefrom away from said relatively stationary member, the flat body and legs together defining an outwardly opening channel to receive and retain a slidable flush bolt;

said slidable flush bolt being a thin, flat elongated member having opposed sides and an elongated slot therethrough;

resilient means in said channel to engage each side of said flush bolt to slide with said flush bolt and to frictionally retain said flush bolt in said channel;

means for fastening said channel to said stationary member;

said fastening means extending through said slot for limiting the sliding movement of said flush bolt in said channel; and a thermally insulating material interposed between said stop member and said body, said stop member being secured to one edge of said thermally insulating material and said second leg being connected to the other edge of said thermally insulating material so that said thermally insulating material forms a thermal barrier between the astragal body and the astragal stop member;

said stop member preventing swinging of said relatively movable door past the relatively stationary member in a first direction and said first leg of said channel cooperating with said door latch to prevent swinging movement of said relatively active member past said relatively stationary member in the opposite direction.

2. The invention as defined in claim 1, wherein said outwardly opening channel receives and retains a door latch from the active door member; said first leg includes a flange extending outwardly away from said stop member and generally parallel to said body, said flange serving as a striker plate for the latch bolt of said active door member.

3. The invention as defined in claim 1, wherein each leg includes an inwardly facing opposed flange, each inwardly facing flange and said flat body defining a guide path therebetween for said slidable flush bolt assembly.

4. The invention as defined in claim 1, wherein said stop member further includes an elongated weather strip to seal against said relatively active door member when said relatively active door member is in a closed position.

5. The invention as defined in claim 4, wherein said weather strip includes a magnetic member to hold said weather strip against a metal or metal-covered door.

6. In an astragal assembly to be secured to a relatively inactive member such as a door jamb or the edge of an inactive door of a double door or the like, said astragal including a generally flat elongated base to be mounted on said inactive member and a stop member mounted transversely of said base and along one edge thereof to limit swinging movement of a relatively active door member, the improvement comprising:

first and second spaced apart elongated legs formed integrally with said base and extending outwardly therefrom away from said inactive member toward said active member when said active member is closed, the legs and base defining a channel to receive and retain a latch bolt from the active member;

each of said legs including an inwardly facing flange with the inwardly facing flange and said base defining a guide for a flush bolt; and at least one flush bolt slidably mounted in said guide at one end thereof; said flush bolt having an elongated slot therethrough;

means extending through said slot for both fastening said channel to said inactive member and for limiting the sliding movement of said flush bolt; and a thermally insulating material interposed between said stop member and said body, said stop member being secured to one edge of said thermally insulating material and said second leg being connected to the other edge of said thermally insulating material so that said thermally insulating material forms a thermal barrier between the astragal body and the astragal stop member;

so that upon closing said inactive door and sliding the flush bolt, the flush bolt may engage a conventional keeper or the like to maintain said inactive door in a closed position and, said stop member prevents swinging movement of said active door past a closed position and further said first leg of said channel receiving a latch bolt from said active door member to prevent swinging of said active member toward an open position.

7. The invention as defined in claim 6, and further including a spring positioned in said guide to engage the side of said flush bolt to frictionally retain said flush bolt in said guide against inadvertent sliding.

8. The invention as defined in claim 6, wherein said first leg includes a flange extending outwardly generally parallel to said base, and away from said stop member, said flange being a striker plate for the latch bolt of said active member.

* * * * *